US005209149A

United States Patent [19]

Mohr

[11] Patent Number: 5,209,149

[45] Date of Patent: May 11, 1993

[54] APPARATUS FOR THE CUTTING OF STACKED SHEET-LIKE MATERIAL

[76] Inventor: Wolfgang Mohr, Hundshager Weg 42,D-6238, Hofheim/Taunus, Fed. Rep. of Germany

[21] Appl. No.: 690,652

[22] Filed: Apr. 24, 1991

[30] Foreign Application Priority Data

Apr. 25, 1990 [DE] Fed. Rep. of Germany ..... 4013352

[51] Int. Cl.[5] ..... B26D 7/01; B26D 7/18

[52] U.S. Cl. ..... 83/91; 83/157; 83/160; 83/162; 83/452; 83/467.1

[58] Field of Search ..... 83/86, 90, 91, 93, 157, 83/158, 162, 160, 385, 391, 467.1, 468.1, 452, 456, 468.6, 468.7; 414/788, 790.3

[56] References Cited

U.S. PATENT DOCUMENTS

| | | | |
|---|---|---|---|
| 3,744,649 | 7/1973 | Ward, Jr. | 414/790.3 X |
| 4,445,409 | 5/1984 | Mohr et al. | 83/157 |
| 4,474,093 | 10/1984 | Neubuser et al. | 83/91 X |
| 4,850,257 | 7/1989 | Mohr | 83/93 |

FOREIGN PATENT DOCUMENTS 3803273 11/1989 Fed. Rep. of Germany .

*Primary Examiner*—Eugenia Jones

*Attorney, Agent, or Firm*—Robert P. Simpson; Michael L. Dunn

[57] ABSTRACT

The invention comprises an apparatus for cutting stacked sheet-like material, including:

a table having a surface upon which the material may be laid, the table being defined to be within a work zone, a cutting knife and a press bar located above the work zone, an entry zone located behind the work zone for receiving the material to be cut, an advance device for advancing the stack of material into the work zone in the direction of the cutting knife, an element having a surface for receiving the material after it is cut, the element being defined to be within an exit zone, the element being movable relative to the work zone to form a gap therebetween, a first straight guide, tiltable about a horizontal axis in order to support the stack of material during cutting and to subsequently erect the cut stack, a second straight guide which is located behind the first straight guide which is operatively arranged to be brought into its working position after the gap has been opened, to form a transverse channel between the first and second straight guides within which channel the cut material is located, a holding-down device for securing the cut material in place upon the first guide, and an ejector element movable within the transverse channel which ejector element is operatively arranged to remove the cut material from the transverse channel.

22 Claims, 4 Drawing Sheets

APPARATUS FOR THE CUTTING OF STACKED SHEET-LIKE MATERIAL

Figure 1:
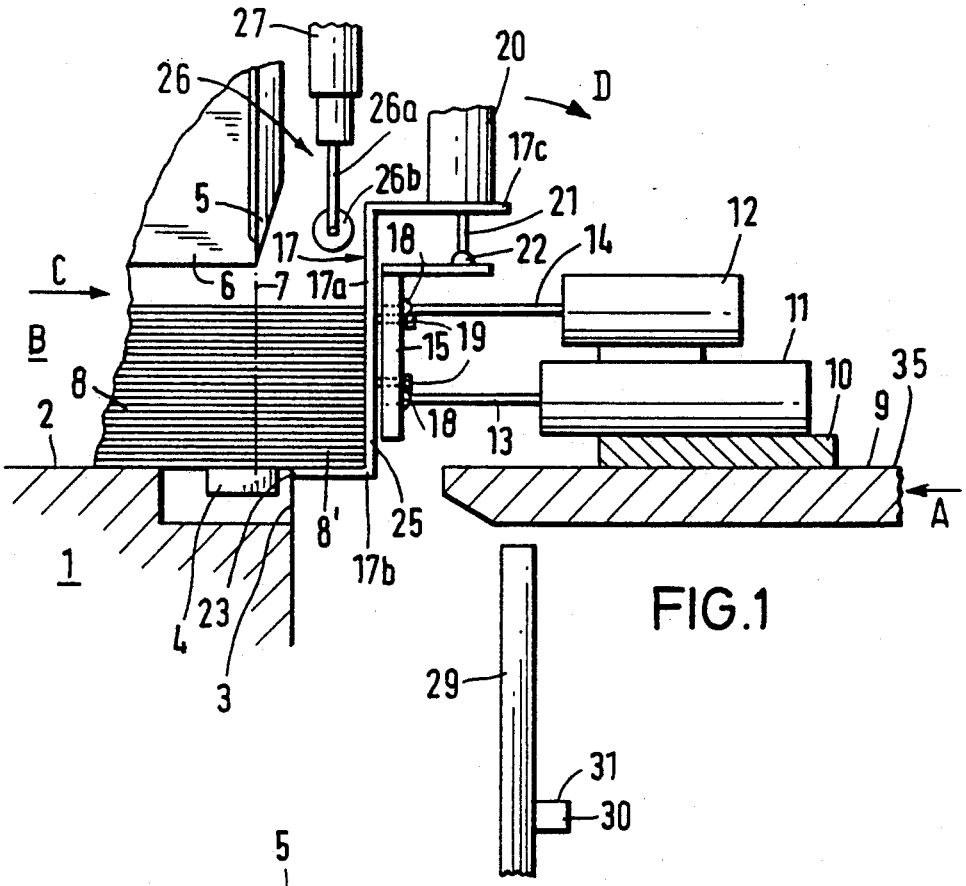

The invention relates to an apparatus for the cutting of stacked sheet-like material, with a table surface which has a work zone, above which a cutting knife and a press bar are located, behind which is an entry zone for receiving the material to be cut and in front of which is an exit zone for receiving the cut material, and with an advance device for the material to be cut, the exit zone being movable relative to the work zone to form a gap, and a transverse channel leading to a further-processing station being provided on the exit zone and having an ejector movable along the transverse channel, furthermore the transverse channel being formed between a first straight guide tiltable about a horizontal axis, in order to support the stack of cut material during cutting and subsequently erect it again, and a second straight guide which is located behind the first straight guide and which can be brought into its working position after the opening of the gap, and a holding-down device which can be laid onto the cut material being provided.

An apparatus of this type for the cutting of stacked sheetlike material is known from DE 3,613,316 C1. In this, the two straight guides serve, among other things, the purpose of forming the transverse channel, through which the cut material, that is to say block strips or blocks, located between the straight guides can be pushed out to the further-processing station by means of the ejector. To support the advanced material securely immediately before the cutting, this being necessary because of the geometry of the cutting knife and the parallelogram shape of the material consequently obtained after cutting, the first straight guide there is tiltable about a lower horizontal axis, in order thereby to support the stack of cut material during cutting and subsequently erect it again vertically up against the second straight guide movable into its working position after the formation of the gap. While the material is being cut, a holding-down device is laid onto the top ff this, improves its hold and, furthermore, ensures that the sheet-like material, especially if it is somewhat brittle, does not jump away over the straight guide during cutting.

Although the known apparatus has proved appropriate in practice, it is beset by the problem of safely handling relatively high stacks narrow in the direction of advance and consisting of small labels, bands or the like, an extension of the stacks in the direction of advance being reckoned as at most approximately 25 mm here. Precisely when thicknesses are less than 25 mm, during the opening of the gap the stack tends to tip, even before the first straight guide can be brought into its working position, because of the angle which is obtained after cutting between its resting surface and the laying surface on the first straight guide and which is substantially larger than 90°.

The object of the present invention is to develop an apparatus of the type mentioned in such a way that even cut stacks of small thickness can be processed simply and reliably with this.

The object is achieved in that the first straight guide has a resting surface and a laying surface arranged at right angles to this for the cut material, in the erected position of the straight guide the resting surface forming essentially one plane with the work zone and having an extension in the direction of advance of the material which is smaller than the extension of the cut material in the direction of advance.

With the gap closed, and with the resting surface of the first straight guide oriented horizontally, the material to be cut is advanced beyond the cutting plane by the amount of the desired narrow item thickness, so that the region of the item projecting beyond the work zone rests completely on the resting surface of the first straight guide forming the exit zone. Because the resting surface forms essentially one plane with the work zone, that is to say coincides with this or is positioned slightly lower than this so as to form a step from the work zone to the resting surface, it is guaranteed that the material to be cut can be pushed over without striking contact with the resting surface of the first straight guide. The smaller extension of the work zone in the direction of advance relative to the extension of the cut material in the direction of advance is obtained because the cutting batten assigned to the work zone is set back relative to the parting plane of the work zone and the exit zone, and according to this offset the first straight guide is shortened in the region of its resting surface in relation to the material present for cutting. During the descent of the cutting knife, because of its wedge shape the material to be cut off is displaced in parallelogram form, the first straight guide being tilted according to the shifting movement of the material. The right-angled arrangement of the resting surface and the laying surface of the first straight guide ensures, at every moment of the cutting of the item and the tilting movement of the first straight guide, that the item is held securely in the tilted position by the first straight guide. With the first straight guide tilted, the gap is formed between this and the work zone, the second straight guide is then extended into its working position, and finally the first straight guide is once again tilted back into the horizontal position of the resting surface and the vertical position of the laying surface, in this position the particular item being guided specifically between the two straight guides. Before the items are ejected, the first straight guide is moved away from the items slightly in the direction of advance of the material to be cut, so that a possible jamming of the items is cancelled and these can then be fed to the further-processing station by means of the ejector.

Preferably, the first straight guide can be tilted by an angle of approximately 3020 out of the vertical away from the cutting plane in relation to its laying surface for the cut material. The resting surface of the first straight guide preferably has an extension in the direction of advance of the material to be cut of 10 to 20 mm, especially 15 to 20 mm, and the cut material preferably has an extension in the direction of advance of 15 to 25 mm, especially 20 to 25 mm.

According to a particular embodiment of the invention, the first straight guide has two legs which are arranged in an L-shaped manner and which have the receiving surface and the laying surface.

To bring about the tilting movement of the first straight guide, there is preferably essentially a vertically oriented bearing plate which is movable horizontally and inclinable, and in the bearing plate the leg of the first straight guide having the laying surface is mounted movably in the plane of the bearing plate and can move essentially in the vertical direction. Expediently, first pneumatic cylinders engage pivotably with the free ends of their piston rods, at a distance from the leg intersection line of the legs, on the leg of the first straight guide having the laying surface, furthermore second pneumatic cylinders engage pivotably with the free ends of their piston rods, at a greater distance from the leg intersection line of the legs, on the leg of the first straight guide having the resting surface, and third pneumatic cylinders effective essentially in the transverse direction of the bearing plate and of the leg having the laying surface connect these legs and the bearing plate nonpositively to one another. The leg of the first straight guide having the laying surface should be connected, at its end facing away from the leg having the resting surface, to a further bearing leg which is oriented in the opposite direction to the leg having the resting surface and which receives the third pneumatic cylinders, the piston rods of which are connected to appendages of the bearing plate on the side facing away from the first straight guide. Loading the straight guide or the bearing plate by means of three means of force effective independently of one another makes it possible to execute a tilting movement of the first straight guide out of the vertical position of the leg having the laying surface which is obtained from a superposition of the movement of the first and second pneumatic cylinders away from the material to be cut and of the downward movement of the first straight guide by means of the third pneumatic cylinders. This ensures that the edge, facing the work zone, of the leg of the first straight guide having the laying surface does not pass beyond the plane of the work zone during the tilting.

In detail, the first pneumatic cylinders should be movable with one movement component respectively in and opposite to the direction of advance of the material to be cut and the second pneumatic cylinders be coupled motionally to the first pneumatic cylinders, whilst the movement of the piston rod of the first and second pneumatic cylinders should take place respectively in and opposite to the direction of advance of the material to be cut.

Because of the smaller extension of the work zone in the direction of advance in relation to the extension of the cut material in this direction, the second straight guide should be equipped, on its side facing the exit zone, with a supporting batten, the upper supporting plane of which forms approximately one plane with the resting surface of the first straight guide in its horizontal position. The purpose of this design of the second straight guide is to ensure that, with the second straight guide extended, its supporting batten supports the items projecting beyond the resting surface of the first straight guide.

Advantageously, the holding-down device for fixing the material during cutting is arranged on the side of the cutting knife facing away from the press bar and can be lowered onto the material in synchronism with the knife movement via separate actuating means. The holding-down device is expediently designed as a spring element, especially a leaf-spring element, which, at its lower end remote from the knife, has a rotatable holding-down roller mounted parallel to the leg intersection line.

To prevent the items from adhering to the laying surface of the first straight guide, the leg of this straight guide having the laying surface should be equipped with a plurality of passage holes of small diameter. This ensures that there is no closed laying surface for the items which could entail the danger that the items would adhere to the laying surface.

Further features of the invention are shown in the description of the Figures and in the subclaims, and it is noted that all the individual features and all combinations of individual features are essential to the invention.

Figure 2:
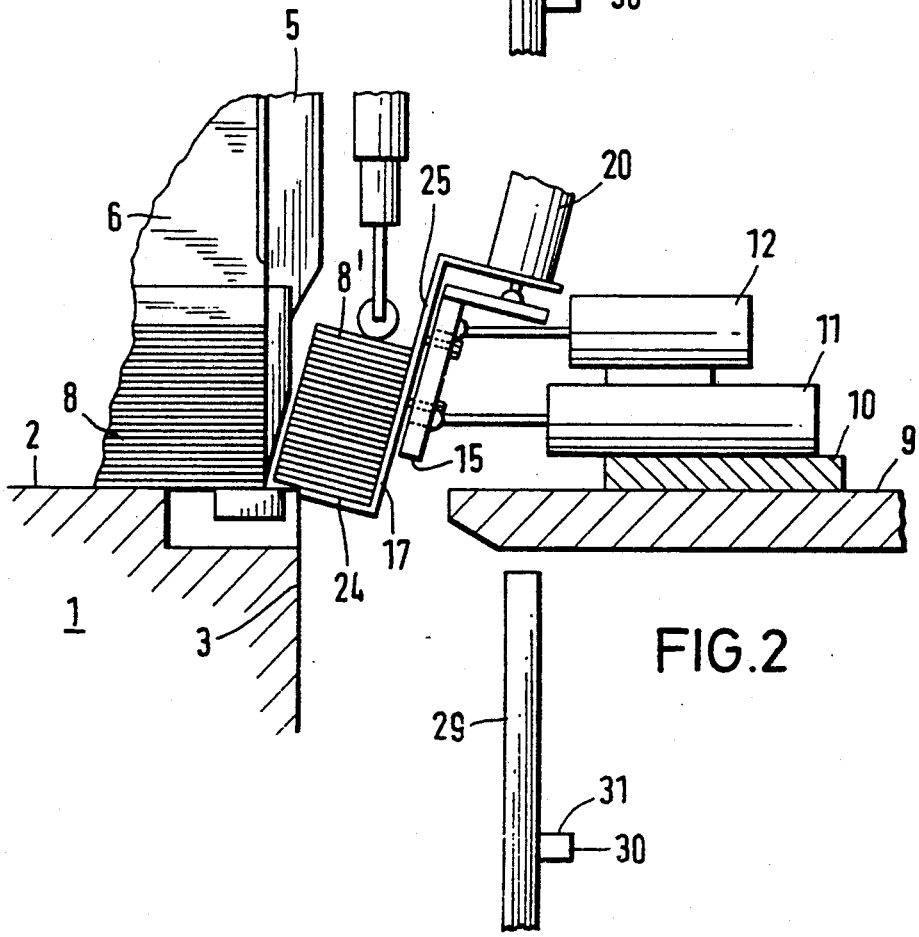
Figure 3:
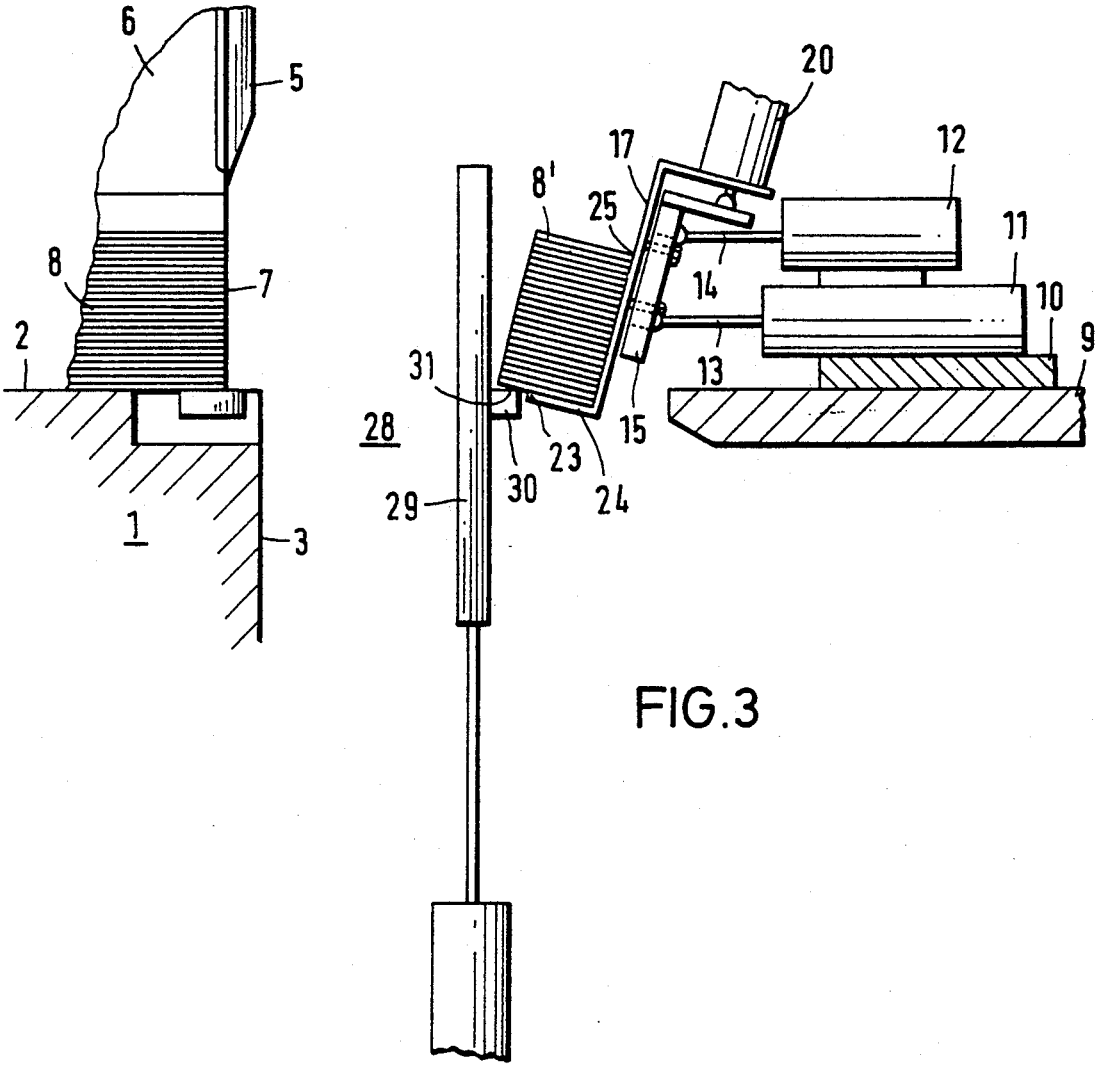
Figure 4:
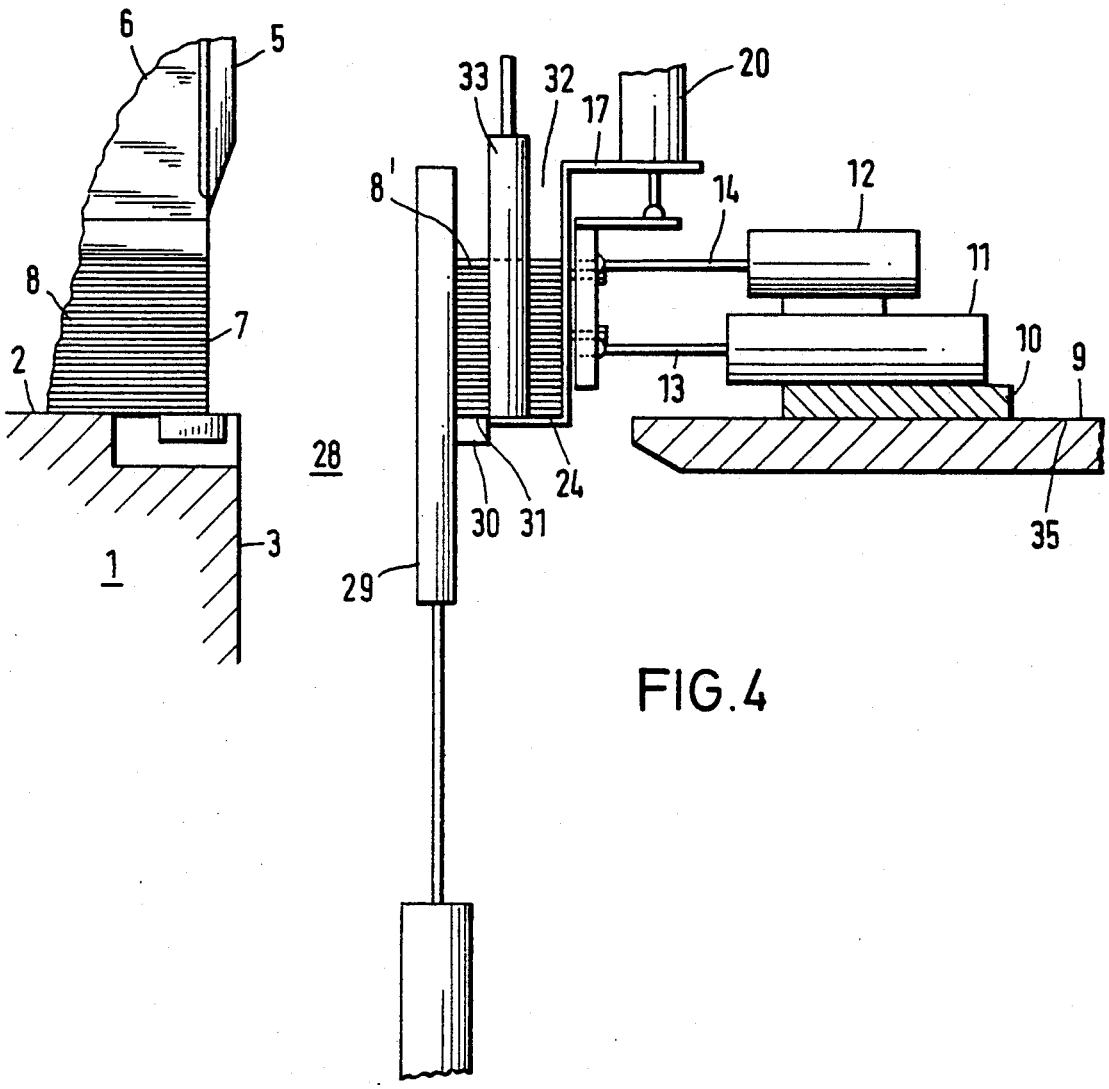
Figure 5:
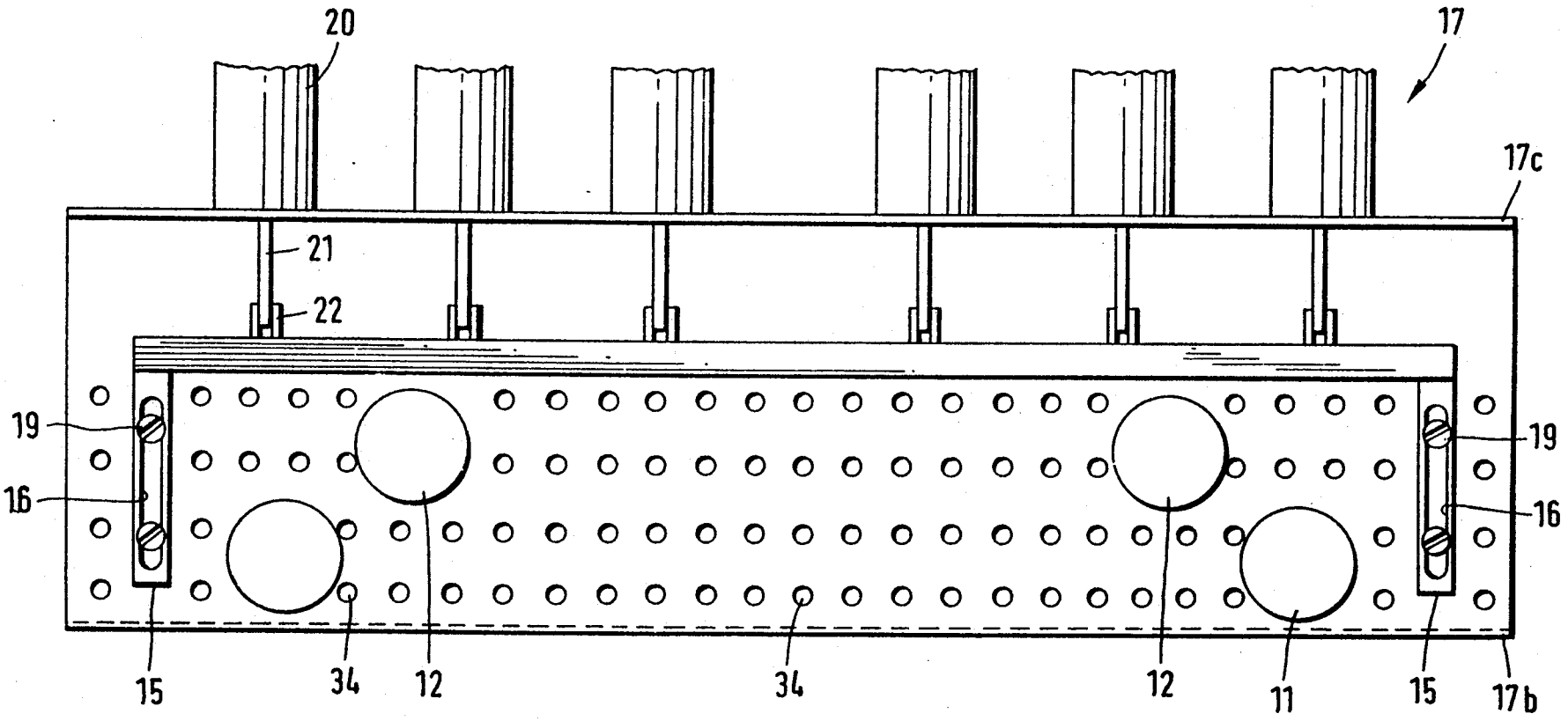

The invention is diagrammatically illustrated by way of example in the Figures by means of one embodiment, without being restricted to this. In these:

FIG. 1 shows a section through the apparatus according to the invention in the region of the cutting plane, perpendicularly to the latter, before an item cut, FIG. 2 shows a representation according to that of FIG. 1, after the item cut, FIG. 3 shows a section through the apparatus after a gap has been formed between the work zone and exit zone, with the first straight guide still tilted and the second straight guide extended, FIG. 4 shows a representation according to that of FIG. 3, after the first straight guide has been transferred into the vertical position of the laying surface, with the ejector lowered, and FIG. 5 shows a view of the apparatus according to the arrow A in FIG. 1.

FIG. 1 shows a table part 1 of the apparatus with an associated work zone 2, into which is embedded adjacent to its front edge 3 a cutting batten 4 extending parallel to this. Arranged above the cutting batten 4 and therefore the work zone 2 are a cutting knife 5 and, adjacent to and behind this, a press bar 6. The cutting plane extending perpendicular to the work zone 2 is designated by the reference numeral 7. A stack 8 of stacked sheet-like material lies on the table part 1 which is formed by the work zone 2 and by an entry zone located in the region B, not shown in any more detail, of the apparatus. Arranged behind the stack 8 and therefore likewise in the region B of the apparatus is an advance device which serves for advancing the stack 8 in the direction of advance, that is to say perpendicularly to the cutting plane 7.

At a distance from the table part 1, the apparatus has a further table part 9, in which a slide 10 extending perpendicularly to the drawing plane and arranged symmetrically relative to half the extension of the cutting batten 4 is mounted movably in the direction of advance C and in the opposite direction. The movement of the slide 10 is obtained via means of force, not shown in any more detail, which are embedded in the table part 9 and which engage on the underside of the slide 10. Provided symmetrically relative to half the length of the cutting batten and at a distance from one another of approximately half the length of the cutting batten are two feed cylinders 11 which are mounted on the slide 10. A pivoting cylinder 12 is connected to the top side of each feed cylinder 11 at a distance from this. The cylinders 11 and 12 are pneumatic cylinders, the piston rods 13 and 14 of which are oriented horizontally in the direction of advance C. The piston rod 14 is guided in the bearing plate 15 with play in the transverse direction of the latter, in order to allow for the increase in the engagement distance between the piston rods 13, 14 which occurs during the pivoting of the bearing plate 15. FIG. 1 shows the extended position of the piston rods 13 and 14. According to the length of the slide 10, there is a bearing plate 15 which extends perpendicularly relative to the drawing plane and which is likewise arranged symmetrically relative to half the length of the cutting batten. In respect of the representation of FIG. 1, the bearing plate is oriented vertically, and the piston rods 13 and 14 engage in pairs on this at a vertical distance from one another. At a slight lateral distance from the respective piston rods 13 and 14, the bearing plate 15 is equipped between the piston rods 14 with two long holes 16 (shown in FIG. 5) extending over a large part of the width of the bearing plate 15 and therefore vertically. As can also be taken from the representation of FIG. 1, the apparatus has a first straight guide 17 which consists of a middle vertical leg 17*a*, of a horizontal leg 17*b* connected to the lower end of the vertical leg 17*a* and pointed oppositely to the direction of advance C and of a horizontal leg 17*c* connected to the upper end of the vertical leg 17*a* and pointed in the direction of advance C. At the same time, the first straight guide 17 is once again arranged symmetrically relative to half the length of the cutting batten, the vertical leg 17*a* having a height extension which is larger than that of the bearing plate 15. In vertical alignment with the two long holes 16, the vertical leg 17*a* of the first straight guide 17 is equipped with four bolts 18 on its side facing the bearing plate 15, two bolts passing through each of the long holes 16 and being at a shorter distance from one another than corresponds to the length of the associated long hole 16, so that the vertical leg 17*a* of the first straight guide 17 and the bearing plate 15 are displaceable vertically relative to one another. The respective bolts 18 are secured on the side facing the cylinders 12 and 13 by means of screws 19, the distance between the vertical leg 17*a* and the bearing plate 15 being selected so that the parts can be moved relative to one another comparatively free of play. Fastened to the horizontal leg 17*c* and distributed over its length are six lifting cylinders 20, the downwardly directed piston rods 21 of which pass through recesses in the horizontal leg 17*c* and engage on lugs 22 attached to the top of the bearing plate 15.

As can furthermore be taken from the representation of FIG. 1, with the piston rods 13 and 14 extended the first straight guide 17, guided by means of the bearing plate 15 via the cylinders 11 and 12, bears against the table part 1 with its edge 23 of the horizontal leg 17*b* facing the table part 1, it being sufficient for the functioning of the apparatus if a slight gap is formed between the parts. In the position of the piston rods 21 of the lifting cylinders 20 which is shown in FIG. 1 and in which these are extended to the maximum extent, a resting surface formed on the surface of the horizontal leg 17*b* is arranged slightly below the plane of the work zone 2 of the table part 1. The vertical leg 17*b* of the first straight guide 17 has a height extension which corresponds approximately to the vertical distance between the table part 1 and the raised press bar 6, the surface of the vertical leg 17*a* constituting a laying surface 25.

Finally, a holding-down device 26 is arranged between the cutting knife 5 and the lifting cylinders 20. An actuating drive connected to a gantry of the apparatus, not shown in any more detail and also receiving the cutting knife 5 and the press bar 6, raises and lowers the holding-down device 26 in synchronism with the knife movement. The holding-down device 26 has a spring element 26*a* which is connected to the actuating drive 27 and which, at its lower end remote from the knife, has a holding-down roller 26*b* mounted parallel to the cutting batten 4 and extending over the length of the first straight guide 17.

The mode of operation of the apparatus will be described below:

Starting from the representation in FIG. 1, the material 8 to be cut is advanced by means of the advance device, not shown in any more detail, until it comes up against the vertical leg 17*a* of the first straight guide 17. The material 8 thus projects beyond the cutting plane 7 by the amount of a length to be cut off, and after the cut there will be an item 8'. This can be a single item 8' which extends over the entire width of the stack 8, but the intention is primarily that there already be a plurality of stacks 8 oriented in the direction of advance C and arranged next to one another, so that, after the cut, individual blocks arranged in succession perpendicularly to the drawing plane in the viewing direction are obtained as items 8'.

During the descent of the cutting knife 5, immediately when the knife tip comes in contact with the stack 8, the holding-down roller 26*b* moved down in synchronism with the cutting knife 5 is laid onto the part stack or the blocks 8' and presses these against the first straight guide 17 during the further cutting operation. In synchronism with the severance of the stack 8 and therefore the formation of the item 8', the first straight guide 17 is tilted in the direction of the arrow D about a horizontal axis high extends parallel to the cutting batten 4 and which coincides approximately with the front edge 3 of the table part 1. The tilting movement is composed of a superposition of three movements, namely the retracting movement of the piston rods 13 of the feed cylinders 11, the retracting movement of the piston rods 14 of the pivoting cylinders 12 and the retracting movement of the piston rods 21 of the lifting cylinders 20. The movement of the feed cylinders 11 leads essentially to a retreat of the first straight guide 17 and the movement of the pivoting cylinders 12 to a pivoting of this straight guide, and the movement of the lifting cylinders 20 causes the first straight guide 17 to be moved downwards in relation to the bearing plate 15 fixed in place relative to the piston rods 13 and 14. The tilted final position of the straight guide 17 emerges from the representation of FIG. 2, and it can be taken from this that the cut item or cut items 8' are in contact with the resting surface 24 and with the laying surface 25 of the first straight guide 17 and the holding-down roller 26*b* is supported on these. The Figure illustrates that the first straight guide 17 is tilted in respect of its laying surface 25 from the vertical away from the sectional plane 7 by an angle of approximately 30° .

The possibility of guiding the slide 10 in the table part 9 serves the purpose of making it possible to set different item thicknesses, but of course it is then also necessary to convert the apparatus in terms of the extension of the horizontal leg 17*b* of the first straight guide 17. The table part 9 is likewise movable in the direction of advance C and in the opposite direction and, as can be taken from the representation of FIG. 3, after the item cut and the raising of the holding-down device 26, is moved in the direction of advance, so that a gap 28 enlarged in comparison with the situation in FIGS. 1 and 2 is obtained. A second straight guide hitherto arranged underneath the table part 9 and extending over the entire length of the first straight guide 17 is then moved vertically upwards, the distance between the second straight guide 29 and the still tilted first straight guide 17 is calculated so that, during the return of the first straight guide 17 to the position in which the leg 17*a* is once again oriented vertically, the surface facing away from the laying surface 25 of the item 8' comes up against the second straight guide 29. The movement of the straight guide into the said vertical position of the vertical leg 17*a* takes place as a result of the extension of the piston rods 13, 14 and 21 of the cylinders 11, 12 and 20, so that the horizontal leg 17*b* of the first straight guide 17 once again comes to rest at the same level as shown in FIG. 1. The situation described is illustrated in FIG. 4, from which it can also be taken that the second straight guide 29, on its side facing the first straight guide 17, is equipped at the height of the horizontal leg 17*b* with a supporting batten 30 which extends perpendicularly to the drawing plane over the entire length of the straight guide 29 and the upper supporting plane 31 of which forms approximately one plane with the resting surface 24 of the first straight guide 17. In the transverse channel 32 thus provided between the two straight guides 17 and 29, an ejector 33 is lowered behind the item 8' as far as the resting surface 24 of the first straight guide 17. Then, by means of an appropriate retracting movement of the piston rods 13 and 14 of the cylinders 11 and 12, the first straight guide 17 is moved slightly away from the second straight guide 29, so that the item 8' can, without being jammed between the two straight guides 17 and 29, be pushed out in the longitudinal direction of the transverse channel by means of the ejector 33 to a further-processing station not shown in any more detail.

The transfer of the first straight guide 17 into the position shown in FIG. 1 takes place after the raising of the ejector 33 and the lowering of the second straight guide 29 and after the return movement of the table part 9 in the direction of the table part 1 and the renewed complete extension of the piston rods 13 and 14 of the cylinders 11 and 12.

FIG. 5 illustrates, among other things, that the vertical leg 17*a* of the first straight guide 17 having the laying surface 25 is equipped with a plurality of passage holes 34 of small diameter.

In the apparatus described, the resting surface 24 of the first straight guide 17 constitutes the exit zone of the table surface. But there is plainly the possibility that the surface 35 of the table part 9 also functions as an exit zone, particularly when the first straight guide 17 is moved by means of the slide 10 in the direction of advance out of the region of the table part 9 facing the table part 1 and the gap 28 between the two table parts 1 and 9 is closed completely, so that the table surface takes the form of a continuous surface of the work zone 2 and the surface 35, that is to say the exit zone. In such a mode of use, cuttings occurring as a result of edge or intermediate cuts are disposed of downwards through the gap 28 after this has previously been opened.

I claim:

1. An apparatus for cutting stacked sheet-like material, comprising:

a table (1) having a surface upon which said material may be laid, said table surface comprising an entry zone which is an area of the table surface where material to be cut first enters the table, and a work zone (2) which is an area of the table surface where the material is cut;

a cutting knife (5) and a press bar (6) located above said work zone, wherein said cutting knife is operatively arranged to cut the material;

an advance device for advancing the stack of material into the work zone in the direction of the cutting knife;

a further table part (9) having a slide (10) slidably mounted thereto;

a first straight guide (17), tiltably mounted to said slide about a horizontal axis, and physically located between said table and said further table part, said guide being movable relative to the work zone to form a gap therebetween, and operatively arranged to support the stack of material during cutting and to subsequently maintain the cut stack in an erect position;

a second straight guide (29) initially located under said further table part and operatively arranged to be raised into a working position between said work zone and said first guide after said gap has been formed, to form a transverse channel between said first and second straight guides within which channel the cut material is located;

a holding-down device (26) for securing the cut material in place upon said first guide; and an ejector element (33) movable within said transverse channel, said ejector element being operatively arranged to remove the cut material from said transverse channel.

2. Apparatus according to claim 1, characterized in that said cutting knife moves up and down in a cutting plane (7) which is perpendicular to the work down and in that the first straight guide (17) can be tilted away from the cutting plane (7) by an angle of approximately 30°.

3. Apparatus according to claim 2, characterized in that the first straight guide (17) has a first horizontal leg (17*b*) having a resting flat surface (24) upon which cut material (8') may be laid, which resting surface forms essentially one plane with the work zone when said first straight guide is in an erect position, and said first straight guide also having a vertical leg (17*a*) at a right angle to said first horizontal leg, said vertical leg having a laying surface (25) which functions to align the cut material.

4. Apparatus according to claim 3, characterized in that there is an essentially vertically oriented bearing plate (15) which is movable horizontally and inclinable, to which bearing plate (15) the vertical leg (17*a*) of the first straight guide (17) having the laying surface (25) is mounted movably in the plane of the bearing plate (15), such that the vertical leg (17*a*) can move essentially in the vertical direction.

5. Apparatus according to claim 4, further including first pneumatic cylinders (11) having associated first piston rods (13) extending therefrom, which first piston rods (13) are pivotally secured to the vertical leg (17*a*) of the first straight guide (17) having the laying surface (25) at a distance removed from the intersection of the resting surface and the laying surface, and also including second pneumatic cylinders (12) having associated second piston rods (14) extending therefrom, which second piston rods (14) are pivotally secured to the vertical leg (17*a*) of the first straight guide (17) having the laying surface (25) at a greater distance from the intersection of the resting surface and the laying surface, and also including third pneumatic cylinders (20) fixedly secured to a second horizontal leg (17*c*) of the first straight guide (17) and having associated third piston rods (21) extending therefrom, which third piston rods (21) are secured to a plate extending transversely from the top of said bearing plate (15).

6. Apparatus according to claim 5, characterized in that the tilting movement of the first straight guide (17) out of the vertical position of the leg (17*a*) having the laying surface (25) takes the form of a superposition of the movement of the first and second pneumatic cylinders (11, 12) away from the material (8) to be cut and the downward movement of the first straight guide (17) by means of the third pneumatic cylinders (20).

7. Apparatus according to claim 6, characterized in that the first pneumatic cylinders (11) are movable with one movement component respectively in and opposite to the direction of advance (C) of the material (8) to be cut, and the second pneumatic cylinders (12) are coupled motionally to the first pneumatic cylinders (11), the movement of the piston rods (13, 14) of the first and second pneumatic cylinders (11, 12) taking place respectively in and opposite to the direction of advance (C) of the material (8) to be cut.

8. Apparatus according to claim 1, characterized in that the first straight guide (17) has a first horizontal leg (17*b*) having a resting flat surface (24) upon which cut material (8') may be laid, which resting surface forms essentially one plane with the work zone when said first straight guide is in an erect position, and said first straight guide also having a vertical leg (17*a*) at a right angle to said first horizontal leg, said vertical leg having a laying surface (25) which functions to align the cut material.

9. Apparatus according to claim 8, characterized in that the resting surface (24) has an extension in the direction of advance (C) of the material (8) to be cut of 10 to 20 mm, and the cut material (8') has an extension in the direction of advance (C) of 15 to 25 mm.

10. Apparatus according to claim 9, characterized in that the second straight guide (29) is equipped on its side facing the exit zone (24, 35), with a supporting batten (30) having an upper supporting plane (31) which coincides approximately with the plane of the resting surface (24) of the first straight guide (17) in its horizontal position.

11. Apparatus according to claim 10, characterized in that the holding-down device (26) is arranged on the side of the cutting knife (5) facing away from the press bar (6) and can be lowered onto the material (8') to be cut in synchronism with the knife movement via separate actuating means (27).

12. Apparatus according to claim 11, characterized in that the holding-down device (26) comprises a spring element (26*a*) which, at its lower end remote from the knife, has a rotatable holding-down roller (26*b*) rotatably mounted to said spring element such that said roller extends longitudinally along and above the stack (8', 13. Apparatus according to claim 12, characterized in that the leg (17*b*) of the first straight guide (17) having the laying surface (25) is equipped with a plurality of passage holes (34) of small diameter.

14. Apparatus according to claim 8, characterized in that there is an essentially vertically oriented bearing plate (15) which is movable horizontally and inclinable, to which bearing plate (15) the vertical leg (17*a*) of the first straight guide (17) having the laying surface (25) is mounted movably in the plane of the bearing plate (15), such that the vertical leg (17*a*) can move essentially in the vertical direction.

15. Apparatus according to claim 14, further including first pneumatic cylinders (11) having associated first piston rods (13) extending therefrom, which first piston rods (13) are pivotally secured to the vertical leg (17*a*) of the first straight guide (17) having the laying surface (25) at a distance removed from the intersection of the resting surface and the laying surface, and also including second pneumatic cylinders (12) having associated second piston rods (14) extending therefrom, which second piston rods (14) are pivotally secured to the vertical leg (17*a*) of the first straight guide (17) having the laying surface (25) at a greater distance from the intersection of the resting surface and the laying surface, and also including third pneumatic cylinders (20) fixedly secured to a second horizontal leg (17*c*) of the first straight guide (17) and having associated third piston rods (21) extending therefrom, which third piston rods (21) are secured to a plate extending transversely from the top of said bearing plate (15).

16. Apparatus according to claim 15, characterized in that the piston rods (13, 14) of the first and second pneumatic cylinders (11, 12), respectively, are movable in the direction of advance (C) of the material (8) to be cut and away from the cutting knife (5).

17. Apparatus according to claim 15, characterized in that the tilting movement of the first straight guide (17) out of the vertical position of the leg (17*a*) having the laying surface (25) takes the form of a superposition of the movement of the first and second pneumatic cylinders (11, 12) away from the material (8) to be cut and the downward movement of the first straight guide (17) by means of the third pneumatic cylinders (20).

18. Apparatus according to claim 14, characterized in that the first pneumatic cylinders (11) are movable with one movement component respectively in and opposite to the directly of advance (C) of the material (8) to be cut, and the second pneumatic cylinders (12) are coupled motionally to the first pneumatic cylinders (11), the movement of the piston rods (13, 14) of the first and second pneumatic cylinders (11, 12) taking place respectively in and opposite to the direction of advance (C) of the material (8) to be cut.

19. Apparatus according to claim 8, characterized in that the second straight guide (29) is equipped on its side facing the exit zone (24, 35), with a supporting batten (30) having an supporting plane (31) which coincides approximately with the plane of the resting surface (24) of the first straight guide (17) in its horizontal position.

20. Apparatus according to claim 8, characterized in that the leg (17*b*) of the first straight guide (17) having the laying surface (25) is equipped with a plurality of passage holes (34) of small diameter.

21. Apparatus according to claim 1, characterized in that the holding-down device (26) is arranged on the side of the cutting knife (5) facing away from the press bar (6) and can be lowered onto the material (8') to be cut in synchronism with the knife movement via separate actuating means (27).

22. Apparatus according to claim 21, characterized in that the holding-down device (26) comprises a spring element (26*a*) which, at its lower end remote from the knife, has a rotatable holding-down roller (26*b*) rotatably mounted to said spring element such that said roller extends longitudinally along and above the stack (8').

* * * * *

UNITED STATES PATENT AND TRADEMARK OFFICE

CERTIFICATE OF CORRECTION

PATENT NO. : 5,209,149
DATED : May 11, 1993
INVENTOR(S) : Wolfgang Mohr

It is certified that error appears in the above-indentified patent and that said Letters Patent is hereby corrected as shown below:

IN THE CLAIMS

In Claim 2, line 3: replace "down" with --zone--;
In Claim 12, line 6: replace "(8'," with --(8').--
In Claim 19, line 4: after "an" add --upper--.

Signed and Sealed this

Twenty-fifth Day of January, 1994

*Attest:*

Bruce Lehman

BRUCE LEHMAN

*Attesting Officer*

*Commissioner of Patents and Trademarks*